US007399204B2

(12) United States Patent
Oono

(10) Patent No.: US 7,399,204 B2
(45) Date of Patent: Jul. 15, 2008

(54) CONNECTOR WITH TERMINALS AND FASTENING METAL FITTINGS HAVING POSITIONING PORTIONS OF THE SAME SHAPE

(75) Inventor: Katsuhiro Oono, Aichi (JP)

(73) Assignee: Tokai Rika Co., Ltd., Aichi (JP)

( * ) Notice: Subject to any disclaimer, the term of this patent is extended or adjusted under 35 U.S.C. 154(b) by 0 days.

(21) Appl. No.: 11/788,670

(22) Filed: Apr. 20, 2007

(65) Prior Publication Data

US 2007/0249230 A1 Oct. 25, 2007

(30) Foreign Application Priority Data

Apr. 20, 2006 (JP) ..... 2006-116725

(51) Int. Cl.
*H01R 13/66* (2006.01)

(52) U.S. Cl. ..... 439/567

(58) Field of Classification Search ..... 439/567, 439/562, 747, 751
See application file for complete search history.

(56) References Cited

U.S. PATENT DOCUMENTS 3,007,132 A * 10/1961 Anderson ..... 439/747
3,535,675 A * 10/1970 Baumanis ..... 439/567
3,950,060 A * 4/1976 Stipanuk et al. ..... 439/329
4,243,289 A * 1/1981 Kozel ..... 439/562
4,929,193 A * 5/1990 Taylor ..... 439/567
6,835,100 B1 * 12/2004 Chen ..... 439/630
6,997,756 B2 * 2/2006 Nakamura ..... 439/751

FOREIGN PATENT DOCUMENTS

JP 08-106969 4/1996

* cited by examiner

*Primary Examiner*—Chandrika Prasad
(74) *Attorney, Agent, or Firm*—Scully, Scott, Murphy & Presser, P.C.

(57) ABSTRACT

A connector (1, 101) includes: terminals (3) electrically connected to a board (P); fastening metal fittings (4) mechanically, fixedly fastened to the board (P); and a connector main body (2), the terminals (3) and the fastening metal fittings (4) being fixedly fastened to the connector main body (2) to have a predetermined positional relationship; in which each of the fastening metal fittings (4) has a positioning portion (13) fixedly fastened to the connector main body (2), and a claw portion (14) having a single protrusion shape, the claw portions (14) being inserted through fastening hole portions of the board (P), thereby preventing the connector (1, 101) from dropping out from the fastening hole portions.

19 Claims, 16 Drawing Sheets

CONNECTOR WITH TERMINALS AND FASTENING METAL FITTINGS HAVING POSITIONING PORTIONS OF THE SAME SHAPE

BACKGROUND OF THE INVENTION

1. Field of the Invention

The invention relates to a connector which is fixedly fastened to a fastening member such as a board.

2. Description of the Related Art

A connector which is fixedly fastened to a board generally includes a plurality of pin-like terminals (pin members) which are electrically connected to the board, and a plurality of fastening metal fittings in each of which a claw portion abutting against a back side of the board is formed. The pin members are disposed in a center side of a connector main body, and the fastening metal fittings are disposed on end portion sides of the connector main body, respectively. This sort of connector, for example, is disclosed in Japanese Patent Laid-open No. 8-106969. In the connector disclosed in Japanese Patent Laid-open No. 8-106969, one fastening metal fitting has two leg portions, and a claw portion is formed in each of the leg portions. That is to say, two claw portions are formed per one fastening metal fitting.

FIG. 15 is a top plan view of a conventional connector.

As shown in FIG. 15, in this connector 701 as well, a plurality of terminals 703, and a plurality of fastening metal fittings 704 are provided in a connector main body 702. The plurality of terminals 703 are transversely disposed, and the fastening metal fittings 704 are disposed on both end sides, that is, left-hand and right-hand end sides of the connector main body 702.

FIG. 16 is a side elavational view partially in cross section of the conventional connector shown in FIG. 15.

As shown in FIG. 16, the fastening metal fitting 704 has two leg portions, and a claw portion 714 is formed in each of the leg portions. The fastening metal fittings 704 are press-fitted from an upper part into the connector main body 702, and the terminals 703 are press-fitted from a lower part into terminal-press-fitted portions 705, respectively.

In this connector 701, the terminals 703 are press-fitted from the lower part into the connector main body 702, while the fastening metal fittings 704 are press-fitted from the upper part into the connector main body 702. Therefore, a press fitting process must be performed at least twice. Also, since each of the press-fitted portions for the terminals 703 is different in shape from that for the fastening metal fittings 704 at all in the connector main body 702, a die with which the connector 702 is formed has a relatively complicated shape.

Now, two claw portions 714 are formed in one fastening metal fitting 704 in each of the connector disclosed in Japanese Patent Laid-open No. 8-106969, and the connector 701 shown in FIGS. 15 and 16, which causes such a problem that a size per one fastening metal fitting 704 becomes large, and thus it is impossible to cope with miniaturization of the entire connector.

SUMMARY OF THE INVENTION

The invention has been made in the light of the circumstances described above, and it is therefore an object of the invention to provide a connector which is capable of being readily manufactured, and coping with miniaturization.

In order to attain the above-mentioned object, according to the invention, there is provided a connector, including:

a plurality of terminals electrically connected to a fastening member;

a plurality of fastening metal fittings mechanically, fixedly fastened to the fastening member; and a connector main body, the terminals and the fastening metal fittings being fixedly fastened to the connector main body so as to have a predetermined positional relationship;

in which each of the fastening metal fittings has a positioning position fixedly fastened to the connector main body, and a claw portion having a single protrusion shape, the claw portions being inserted through fastening hole portions of the fastening member, thereby preventing the connector from dropping out from the fastening hole portions.

According to the connector, since one claw portion is formed in one fastening metal fitting, a size per one fastening metal fitting can be reduced as compared with the conventional connector in which two or more claw portions are formed in one fastening metal fitting. Moreover, the reduction in size of each of the fastening metal fittings results in that a room for selection in design increases with respect to mounting positions for the fastening metal fittings in the connector main body, a shape of the connector main body, and the like.

In addition, in the connector, preferably, each of the terminals has a positioning portion fixedly fastened to the connector main body, and the positioning portion of each of the fastening metal fittings has the same shape as that of the positioning portion of each of the terminals.

In addition, in the connector, preferably, the connector main body has press-fitted portions to which the positioning portions of the fastening metal fittings, and the positioning portions of the terminals are fixedly fastened, respectively.

According to the connector, since the press-fitted portion for each of the terminals has the same shape as that for each of the fastening metal fittings in the connector main body, when the connector main body is formed, a portion, of a shape of a die used in the forming, corresponding to the press-fitted portions for the terminals can be made identical to a portion, of the shape of the die, corresponding to the press-fitted portions of the fastening metal fittings. In addition, in the phase of the assembling of the terminals and the fastening metal fittings to the connector main body, the terminals and the fastening metal fittings may be similarly press-fitted into the connector main body. Therefore, the terminals and the fastening metal fittings can be assembled to the connector main body in the same process.

In addition, in the connector, preferably, the fastening hole portions of the fastening member are engaged with the claw portions of the plurality of fastening metal fittings.

As described above, according to the invention, since the size per one fastening metal fitting can be reduced as compared with that in the conventional connector, it is possible to cope with the miniaturization of the connector. In addition, since the room for selection in design increases with respect to the mounting positions for the fastening metal fittings, and the shape of the connector main body, the connector can be designed in accordance with the required size, specification, etc. Consequently, the connector is very advantageous when being put to practical use.

DETAILED DESCRIPTION OF PREFERRED EMBODIMENTS

Figure 1:
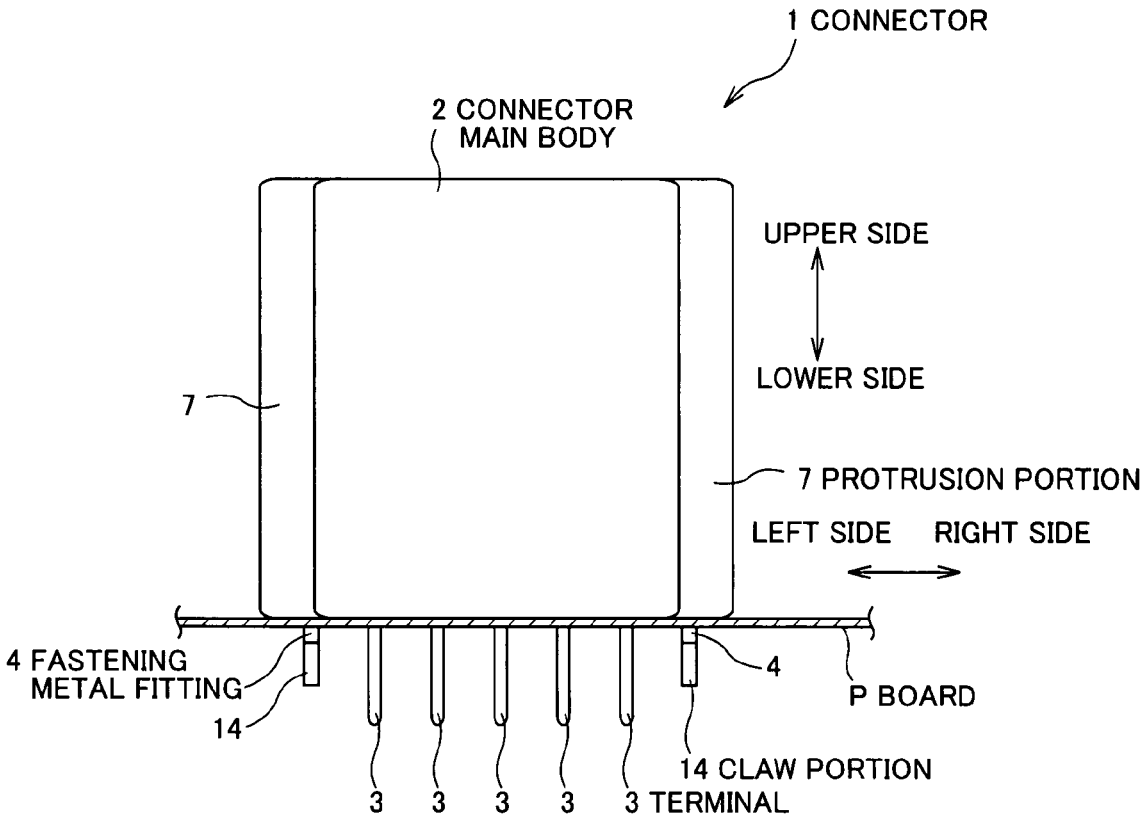
FIG. 1 is a front view of a connector, in a state in which the connector is fixedly fastened to a board, according to a first embodiment of the invention.

A connector according to a first embodiment of the invention will be described in detail hereinafter with reference to FIGS. 1 to 6. FIG. 1 is a front view of a connector, in a state in which the connector is fixedly fastened to a board, according to a first embodiment of the invention.

As shown in FIG. 1, the connector 1 includes a box-like connector main body 2, a plurality of terminals 3 which protrude from the connector main body 2 to a side of a board P serving as a fastening member and are electrically connected to the board P, and a plurality of fastening metal fittings 4 which protrude from the connector main body 2 to the board P side and are mechanically, fixedly fastened to the board P. The plurality of terminals 3 are disposed in a predetermined direction, and the plurality of fastening metal fittings 4 are disposed outside a disposition region of the terminals 3 when viewed from the front. The connector 1 will be described in detail hereinafter on the assumption that a surface side and a back surface side of the board P are an upper side and a lower side, respectively, and the direction along which the terminals 3 are disposed is a transverse direction.

Figure 2:
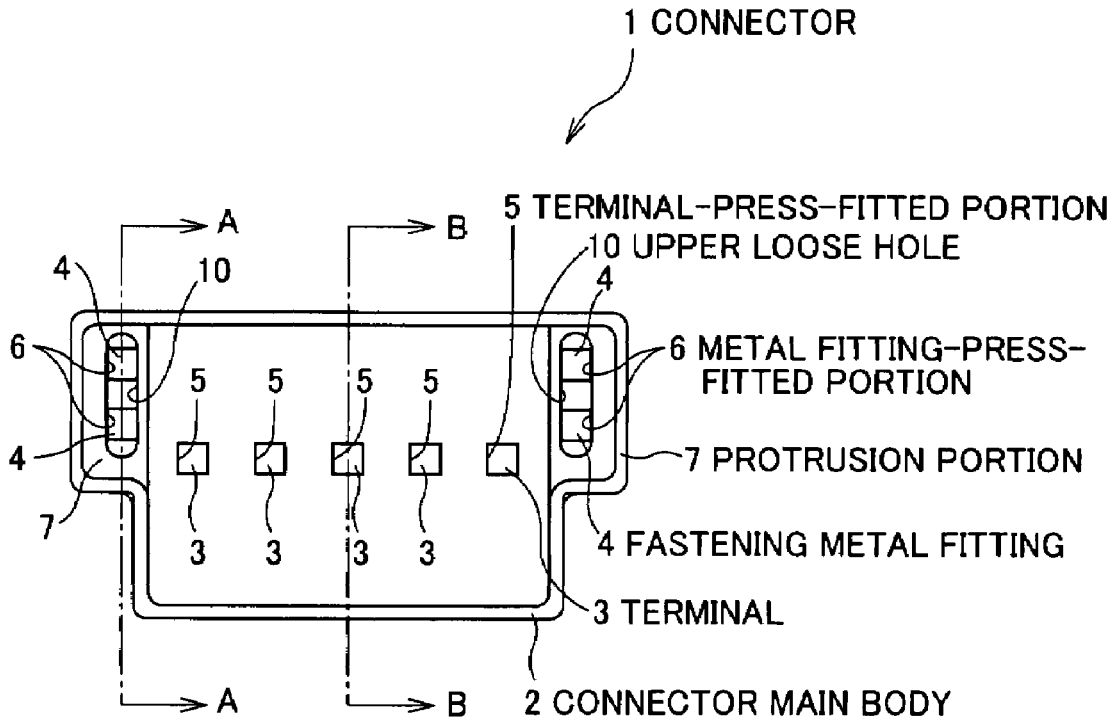
FIG. 2 is a top plan view of the connector shown in FIG. 1.

FIG. 2 is a top plan view of the connector shown in FIG. 1.

The connector main body 2 is formed from a resin, and is formed to be longer in the transverse direction than in the longitudinal direction as shown in FIG. 2. The terminals 3 and the fastening metal fittings 4 are fixedly fastened to the connector main body 2 so as to have a predetermined positional relationship. As shown in FIG. 2, terminal-press-fitted portions 5 into which the terminals 3 are press-fitted, respectively, and metal fitting-press-fitted portions 6 into which the fastening metal fittings 4 are press-fitted, respectively, are formed in the connector main body 2. The five terminal-press-fitted portions 5 are formed in total in a longitudinal center of the connector main body 2 in the transverse direction, and the two metal fitting-press-fitted portions 6 are formed on each of the left-hand and right-hand end portion sides of the connector main body 2, that is, the four metal fitting-press-fitted portions 6 are formed in total. As shown in FIG. 2, the back side of the connector main body 2 protrudes transversely and outward with respect to the front side of the connector main body 2 on each of the left-hand and right-hand both sides. Thus, two protrusion portions 7 are formed on the left-hand and right-hand both sides of the connector main body 2, respectively. Also, the two metal fitting-press-fitted portions 6 are disposed longitudinally side by side every protrusion portion 7.

Figure 3:
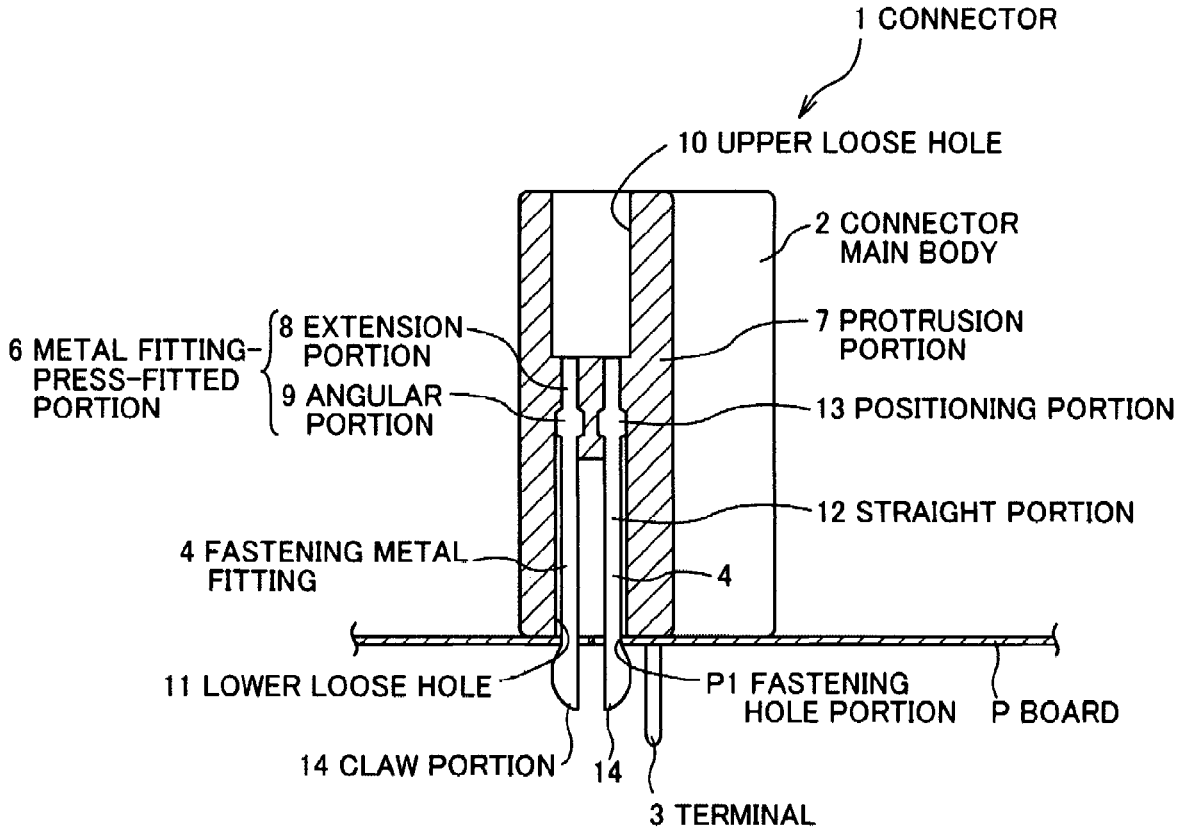
FIG. 3 is a cross sectional view taken on line A-A of FIG. 2.

FIG. 3 is a cross sectional view taken on line A-A of FIG. 2.

As shown in FIG. 3, each of the metal fitting-press-fitted portions 6 is a cavity which is formed inside the connector main body 2, and has an extension portion 8 which vertically extends, and an angular portion 9 which is formed so as to expand longitudinally in a predetermined portion of the extension portion 8. An upper loose hole 10 which extends from an upper end of the connector main body 2 to an upper end of the extension portion 8 is formed above the two adjacent metal fitting-press-fitted portions 6 in each of the protrusion portions 7 of the connector main body 2. Also, a lower loose hole 11 which extends from a lower end of the connector main body 2 to a lower end of the extension portion 8 is formed below the two adjacent metal fitting-press-fitted portions 6 in each of the protrusion portions 7 of the connector main body 2. Each of the upper loose hole 10 and the lower loose hole 11 is formed to have a cross section larger than that of each of the metal fitting-press-fitted portions 6, and communicates with the two adjacent metal fitting-press-fitted portions 6. In addition, fastening hole portions P1 are formed in positions of the board P corresponding to the left-hand and right-hand side protrusion portions 7 of the connector main body 2.

Figure 4:
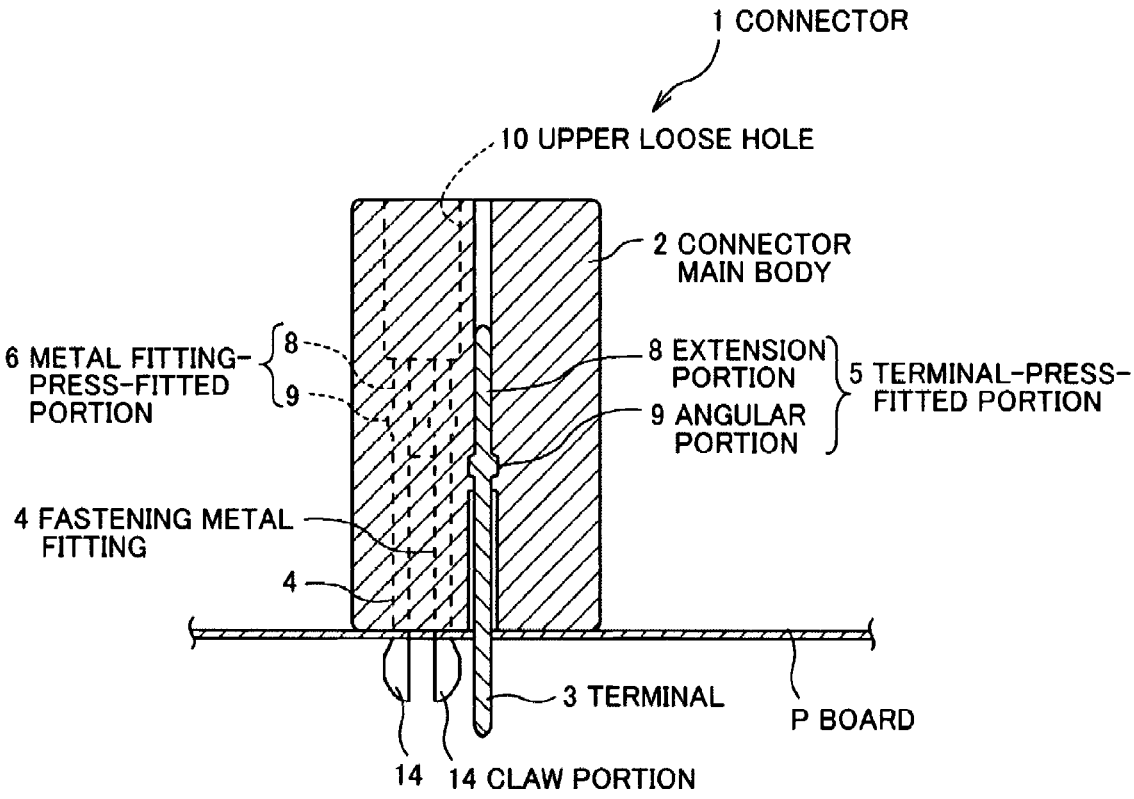
FIG. 4 is a cross sectional view taken on line B-B of FIG. 2.

FIG. 4 is a cross sectional view taken on line B-B of FIG. 2.

As shown in FIG. 4, each of the terminal-press-fitted portions 5 is formed to have the same shape as that of each of the metal fitting-press-fitted portions 6, and has an extension portion 8 which extends vertically in the connector main body 2, and an angular portion 9 which is formed so as to expand longitudinally in a predetermined portion of the extension portion 5. Here, the extension portion 8 of each of the terminal-press-fitted portions 8 is formed to be vertically longer than that of each of the metal fitting-press-fitted portions 6.

Figure 5:
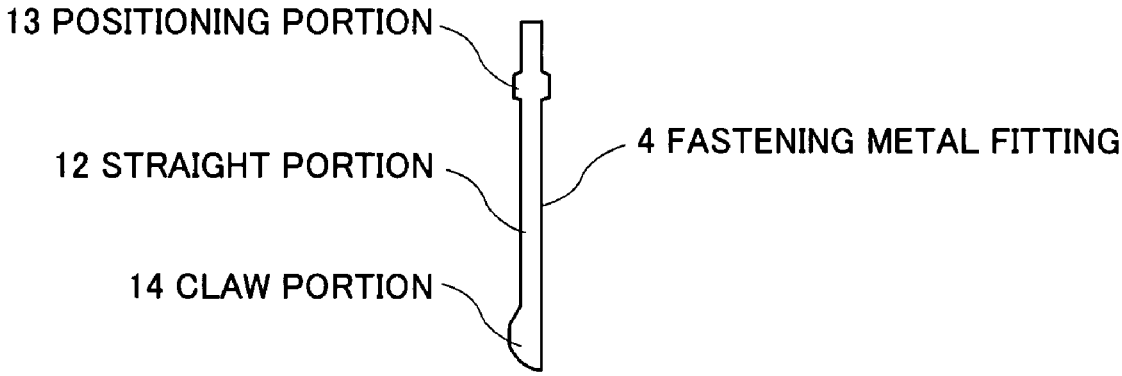
FIG. 5 is a side elevational view of a fastening metal fitting shown in FIG. 1.

FIG. 5 is a side elevational view of the fastening metal fitting shown in FIG. 1.

As shown in FIG. 5, each of the fastening metal fittings 4 has a straight portion (general portion) 12 which is vertically long, a positioning portion 13 which is formed on an upper end side of the straight portion 12 and which is press-fitted into corresponding one of the angular portions 9 of the metal fitting-press-fitted portion 6, and a claw portion which is formed on a lower end side of the straight portion 12 and which is engaged with the back side of the board P. That is to say, the claw portion 14 has a single protrusion shape for preventing the connector 1 from dropping out from the fastening hole portions P1. Each of the claw portion 14 is formed approximately in semicircular shape when viewed from a side face. The claw portion 14 of the fastening metal fitting 4 on the front side in each of the protrusion portions 7 is disposed so as to protrude forward, and the claw portion 14 of the fastening metal fitting 4 on the back side in each of the protrusion portions 7 is disposed so as to protrude backward.

Figure 6:
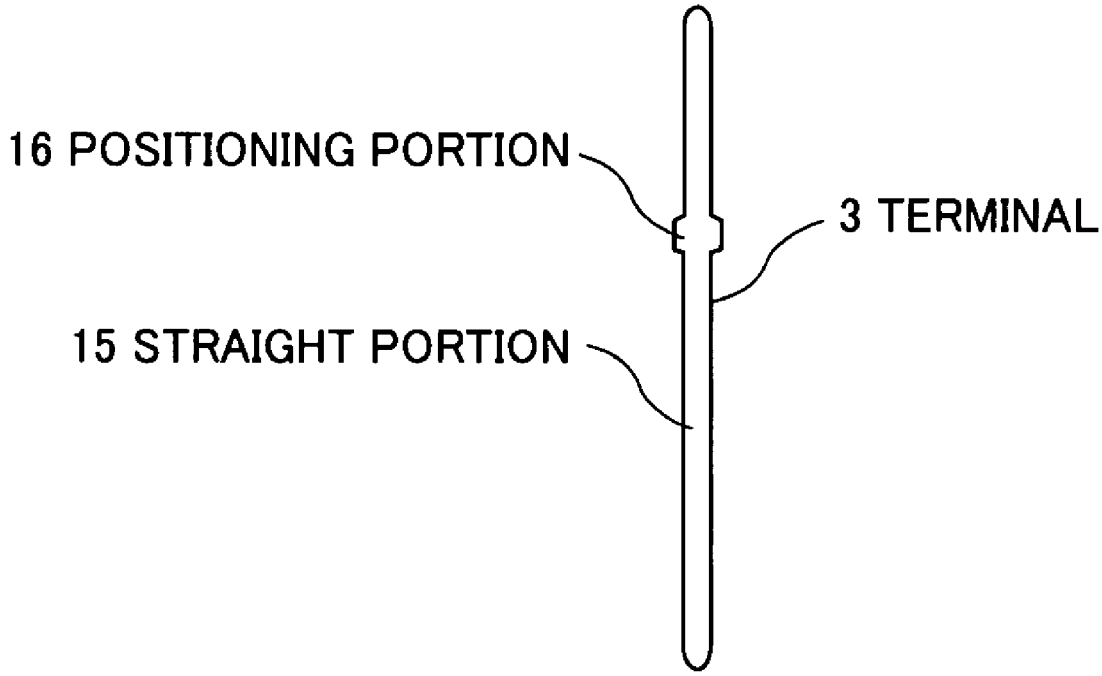
FIG. 6 is a side elevational view of a terminal shown in FIG. 1.

FIG. 6 is a side elevational view of the terminal shown in FIG. 1.

As shown in FIG. 6, each of the terminals 3 has a straight portion (general portion) 15 which vertically long, and a positioning portion 16 which is formed in a vertical center of the straight portion 15 and which is press-fitted into corresponding one of the angular portions 9 of the terminal-press-fitted portions 5. The straight portion 15 is formed to be longer than that 12 of the fastening metal fitting 4, and has approximately the same shape as that of the positioning portion 13 of the fastening metal fitting 4.

In the connector 1 constructed as described above, since each of the terminal-press-fitted portions 5 has the same shape as that of each of the metal fitting-press-fitted portions 6 in the connector main body 2, when the connector main body 2 is formed, a portion, of a shape of a die used in the forming, corresponding to the terminal-press-fitted portion 5 can be made identical to the portion, of the shape of the die, corresponding to the metal fitting-press-fitted portion 6.

In addition, in the shape of the assembling of the terminals 3 and the fastening metal fittings 4 to the connector main body 2, the terminals 3 and the fastening metal fittings 4 may be similary press-fitted into the connector main body 2. Therefore, the terminals 3 and the fastening metal fittings 4 can be assembled to the connector main body 2 in the same process. More specifically, after the terminals 3 and the fastening metal fittings 4 are previously positioned for the terminal press-fitted portions 5 and the metal fitting-press-fitted portion 6, respectively, in a position below the connector main body 2, the terminals 3 and the fastening metal fittings 4 are made to close to the connection main body 2, and are then inserted into the terminal-press-fitted portions 5 and the metal fitting-press-fitted portions 6, respectively, from their upper end sides. Also, when the positioning portions 13 of the terminals 3 and the fastening metal fittings 4 move upward within the extension portions 8 of the terminal-press-fitted portions 5 and the metal fitting-press-fitted portions 6 to reach the angular portions 9 thereof, respectively, the positioning portions 13 of the terminals 3 and the fastening metal fittings 4 are engaged with the angular portions 9 of the terminal-press-fitted portions 5 and the metal fitting-press-fitted portions 6, respectively, thereby completing the press fitting of the terminals 3 and the fastening metal fittings 4 into the terminal-press-fitted portions 5.

After the connector 1 is manufactured in the manner as described above, the claw portions 14 of the fastening metal fittings 4 are made to abut against the back side of the board P, which results in that the connector main body 2 is positioned for the board P, so that the terminals 3 are electrically connected to the board P.

In addition, since one claw portion 14 is formed in one fastening metal fitting 4 in the connector 1, a size per one fastening metal fitting 4 can be reduced as compared with that of the conventional connector in which two or more claw portions are formed in one fastening metal fitting. Moreover, the reduction in size of each of the fastening metal fittings 4 results in that a room for selection in design increases with respect to the mounting positions for the fastening metal fittings 4 in the connector main body 2, the shape of the connector main body 2, and the like.

As described above, according to the connector 1 of this embodiment, the portion, of the shape of the die used in the forming of the connector main body 2, corresponding to the terminal-press-fitted portions 5 can be made identical to the portion, of that shape of the die, corresponding to the metal fitting-press-fitted portions 6. Therefore, the shape of the die can be simplified, thereby reducing the manufacturing cost of the connector 1. In addition, the terminals 3 and the fastening metal fittings 4 can be assembled to the connector main body 2 in the same process, which results in that the number of manufacturing processes can be reduced, and the manufacturing cost can be reduced accordingly.

Moreover, since the size per one fastening metal fitting 4 can be reduced as compared with that in the conventional connector, it is possible to cope with the miniaturization of the connector 1. Furthermore, since a room for selection in design increases with respect to the mounting positions for the fastening metal fittings 4, and the shape of the connector main body 2, the connector 1 can be designed in accordance with the required size, specification, etc. Consequently, the connector 1 is very advantageous when being put to practical use.

In addition, according to the connector 1 of this embodiment, the left-hand and right-hand both end sides of the connector main body 2 are engaged with the board P side by a pair of fastening metal fittings 4 disposed on each of the left-hand and right-hand sides of the connector main body 2, which results in that the connector main body 2 can be stably, fixedly fastened to the board P.

Figure 7:
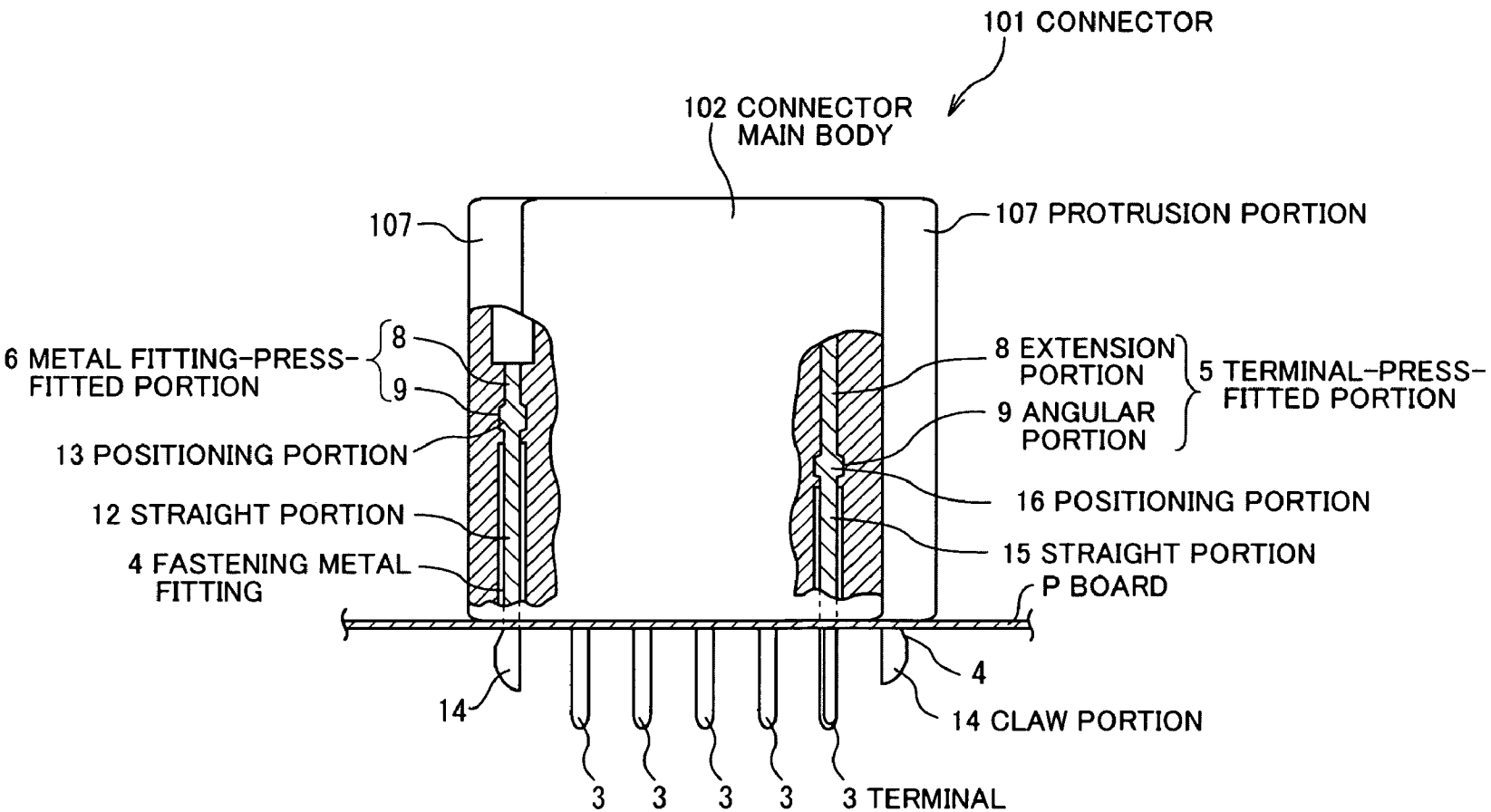
FIG. 7 is a front view partly in cross section of a connector, in a state in which the connector is fixedly fastened to a board, according to a second embodiment of the invention.

A connector according to a second embodiment of the invention will be described in detail hereinafter with reference to FIGS. 7 to 9. FIG. 7 is a front view partly in cross section of a connector in a state in which the connector is fixedly fastened to a board. Here, the same constituent elements as those of the connector 1 of the first embodiment are designated with the same reference numerals, respectively, and a repeated description is omitted here for the sake of simplicity.

As shown in FIG. 7, the connector 101 includes a box-like connector main body 102, a plurality of terminals 3 which protrude from the connector main body 102 to the board P side and which are electrically connected to the board P, and a plurality of fastening metal fittings 4 which protrude from the connector main body 102 to the board P side and which are engaged with the board P. In this embodiment as well, the plurality of terminals 3 are transversely disposed, and the plurality of fastening metal fittings 4 are transversely disposed outside the disposition region of the terminals 3.

As shown in FIG. 7, each of the terminal-press-fitted portions 5 has the same shape as that of each of the metal fitting-press-fitted portions 6, and has the extension portion 8 which vertically extends within the connector main body 102, and the angular portion 9 which is formed so as to transversely expand in a predetermined portion of the extension portion 8.

Figure 8:
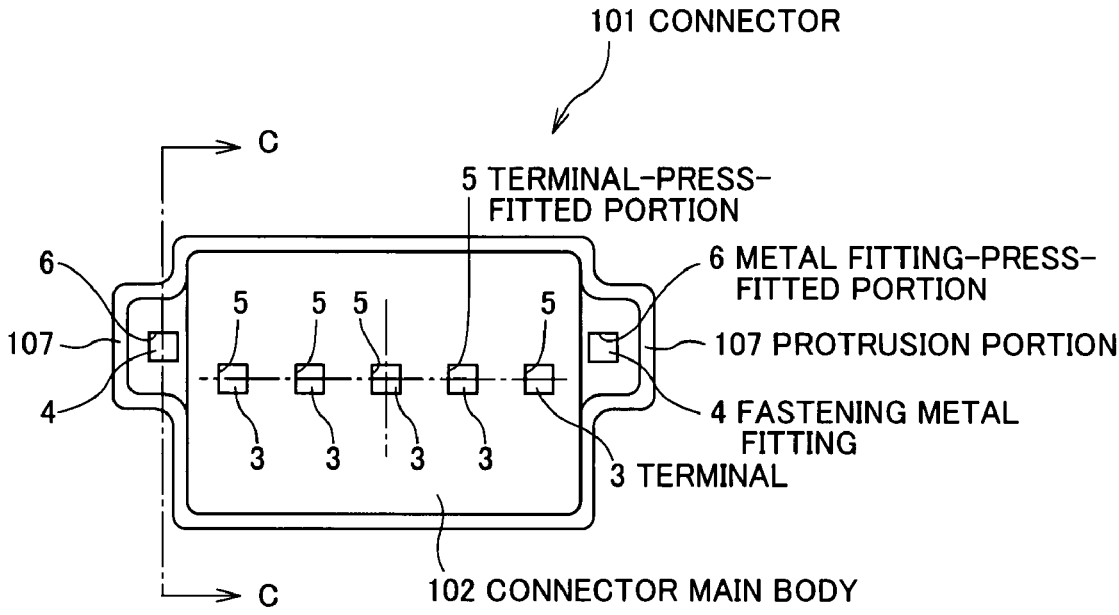
FIG. 8 is a top plan view of the connector shown in FIG. 7.

FIG. 8 is a top plan view of the connector shown in FIG. 7.

The connector main body 102 is formed from a resin, and is formed to be longer in the transverse direction than in the longitudinal direction when viewed from the upper part. The five terminal-press-fitted portions 5 which are transversely disposed in total, and the two metal fitting-press-fitted portions 6 which are disposed in total on the left-hand and right-hand end portion sides of the connector main body 102, respectively, are formed in the connector main body 102. As shown in FIG. 8, a part of the connector main body 102 protrudes transversely and outward on each of the left-hand and right-hand both sides with respect to other parts of the connector main body 102. Thus, two protrusion portions 107 are formed on the left-hand and right-hand both sides of the connector main body 102, respectively. Also, one metal fitting-press-fitted portion 6 is disposed every protrusion portion 107.

Figure 9:
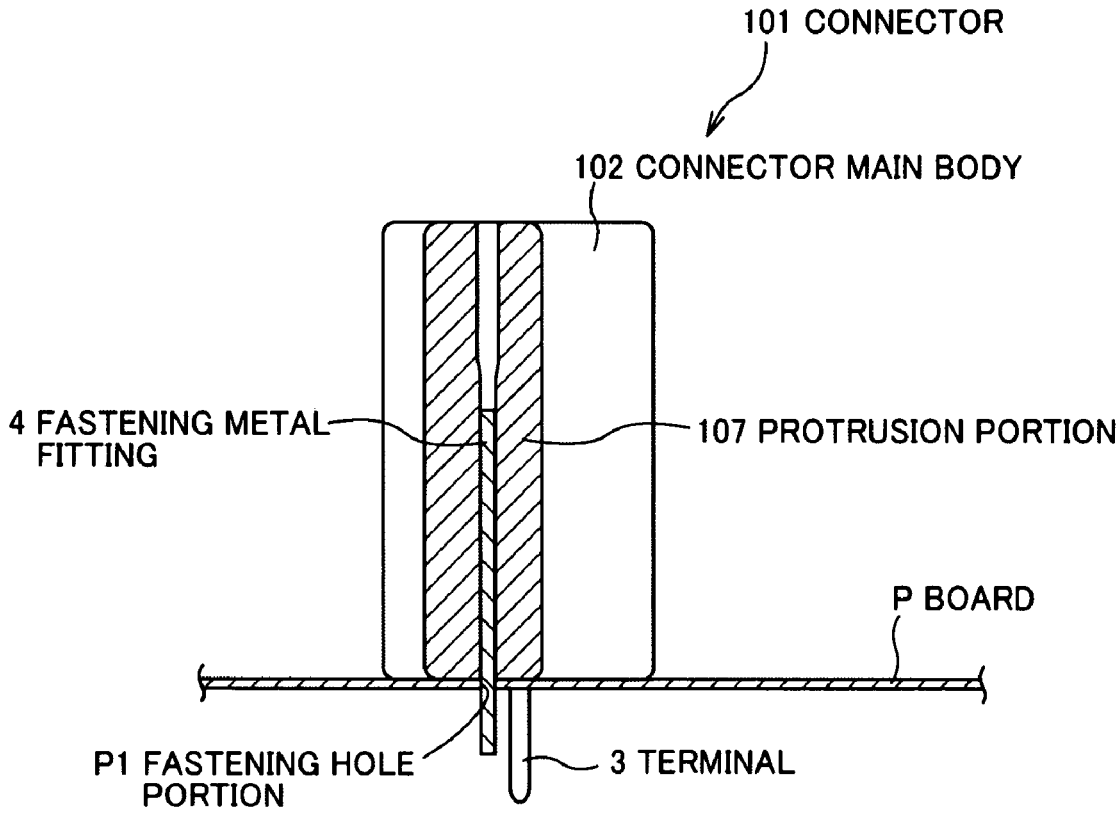
FIG. 9 is a cross sectional view taken on line C-C of FIG. 8.

FIG. 9 is a cross sectional view taken on line C-C of FIG. B.

As shown in FIG. 9, in this embodiment, each of the two protrusion portions 107 is more miniature than that of the first embodiment in which the two metal fitting-press-fitted portions 6 are longitudinally disposed every protrusion portion 7.

According to the connector 101 of this embodiment, a portion, of a shape of a die used in the forming of the connector main body 2, corresponding to the terminal-press-fitted portions 5 can be made identical to a portion, of the shape of the die, corresponding to the metal fitting-press-fitted portions 6. Therefore, the shape of the die can be simplified, thereby reducing the manufacturing cost of the connector 101. In addition, the terminals 3 and the fastening metal fittings 4 can be assembled to the connector main body 102 in the same process, which results in that the number of manufacturing processes can be reduced, and the manufacturing cost can be reduced accordingly.

Moreover, since the size per one fastening metal fitting 4 can be reduced as compared with that in the conventional connector, it is possible to cope with the miniaturization of the connector 101. Furthermore, since the room for selection in design increases with respect to the mounting positions for the fastening metal fittings 4, and the shape of the connector main body 2, the connector 1 can be designed in accordance with the required size, specification, etc. Consequently, the connector 101 is very advantageous when being put to practical use.

In addition, according to the connector 101 of this embodiment, the left-hand and right-hand both end sides of the connector main body 2 are engaged with the board P by a pair of fastening metal fittings 4 disposed on the left-hand and right-hand sides of the connector main body 102, respectively, which results in that the connector main body 102 can be stably, fixedly fastened to the board P. Also, since the claw portions 14 of the fastening metal fittings 4 protrude transversely and outward, the connector main body 102 can be fixedly fastened in a well-balanced state.

Figure 10:
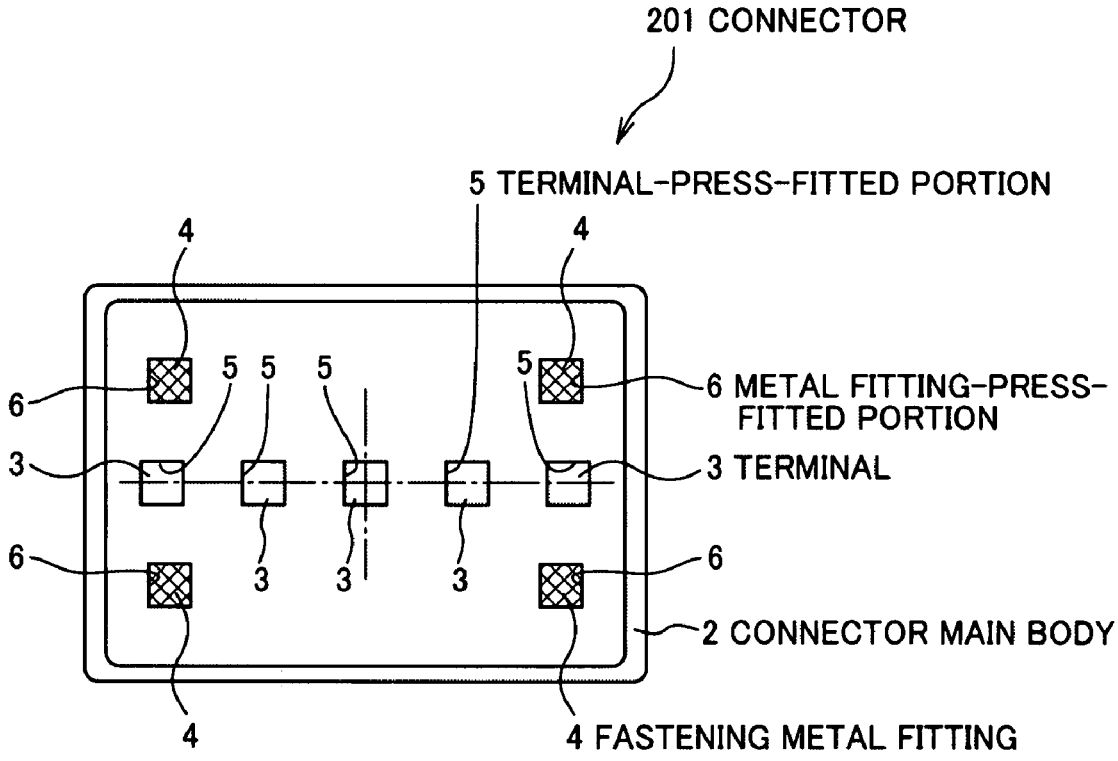
FIG. 10 is a top plan view of a connector according to a first change of the first and second embodiments of the invention.

Note that, although the first and second embodiments have shown the connectors 1 and 101 in which the protrusion portions 7 and 107 protruding transversely and outward are formed in the box-like connector main bodies 2 and 102, respectively, the shape of the connector main body can be arbitrarily formed. For example, as shown in FIG. 10, a connector 201 may also be available in which no protrusion portion is formed in the connector main body 202, and the connector main body 202 is formed approximately in box shape. In this case, in the connector 201, the fastening metal fittings 4 are disposed in four corners of the connector main body 202, respectively, when viewed from the upper part. That is to say, the four fastening metal fittings 4 are disposed not only transversely, but also longitudinally so as to be paired with each other two by two on the both end sides of the connector main body 202.

Figure 11:
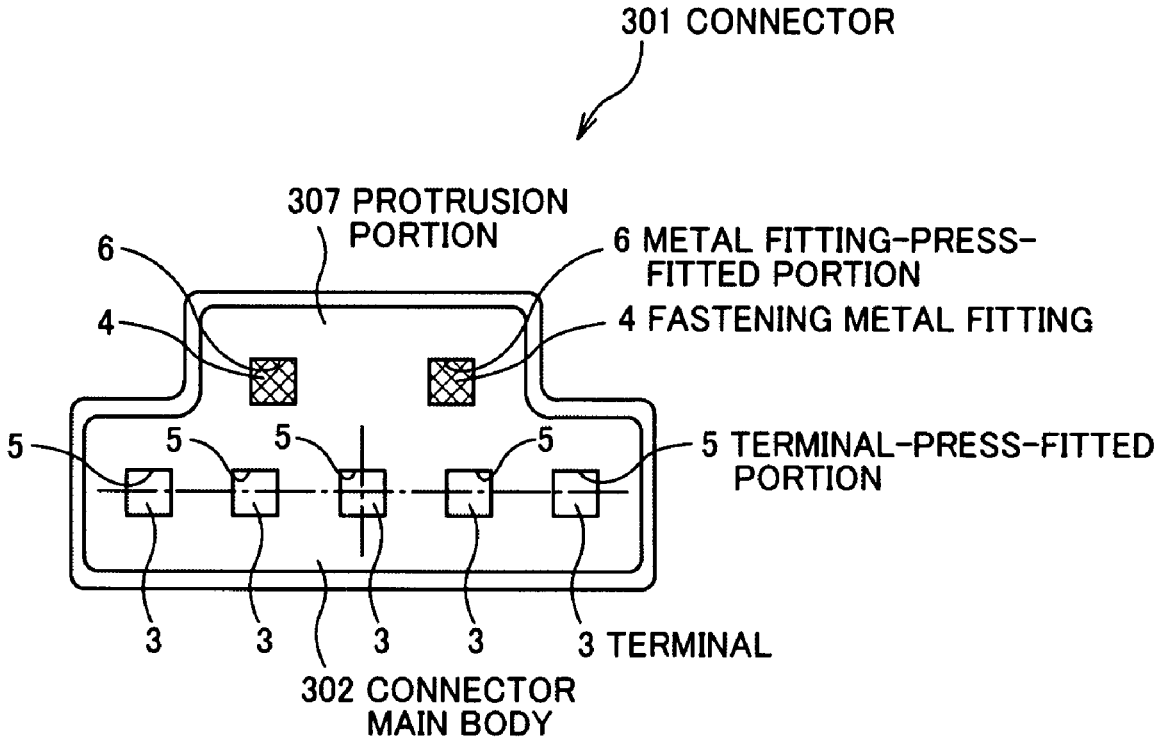
FIG. 11 is a top plan view of a connector according to a second change of the first and second embodiments of the invention.

In addition, for example, as shown in FIG. 11, a connector 301 may also be available in which a protrusion portion 307 protruding backward is formed in a connector main body 302. In this case, in the connector 301, the two fastening metal fittings 4 are disposed transversely inside the protrusion portion 307 so as to be paired with each other on the both end sides of the connector main body 302.

Figure 12:
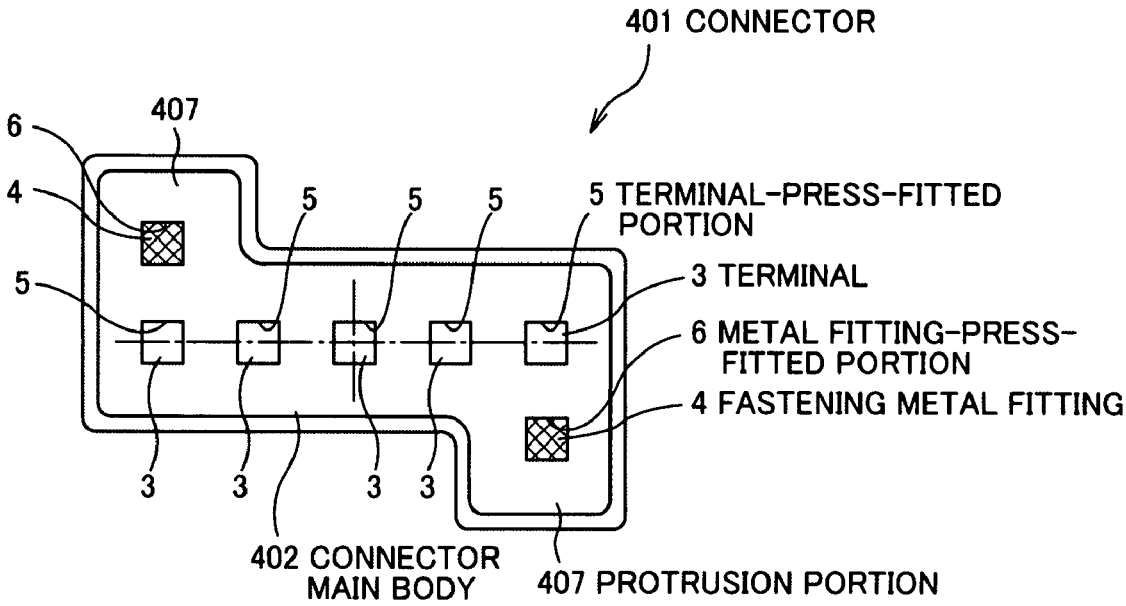
FIG. 12 is a top plan view of a connector according to a third change of the first and second embodiments of the invention.

Moreover, for example, as shown in FIG. 12, a connector 401 may also be available in which one protrusion portion 407 protruding backward is formed in a back portion on the left-hand side of a connector main body 402, and the other protrusion portion 407 protruding forward is formed in a front portion on the right-hand side of the connector main body 402. In this case, in the connector 401, one fastening metal fitting 4 is disposed in each of the two protrusion portions 407, and the fastening metal fittings 4 are also disposed so as to be paired with each other on the both end sides of the connector main body 402 with respect to the transverse direction.

Figure 13:
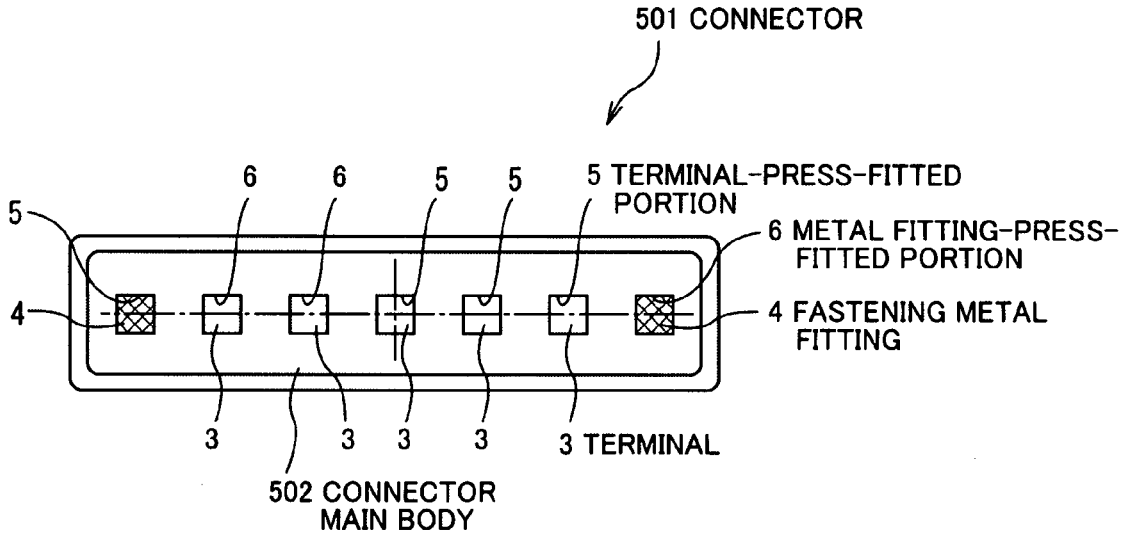
FIG. 13 is a top plan view of a connector according to a fourth change of the first and second embodiments of the invention.

Furthermore, for example, as shown in FIG. 13, a connector 501 may also be available in which a connector main body 502 is formed in straight line shape when viewed from the upper part, and the two fastening metal fittings 4 are disposed in line together with the five terminals 3. In this connector 501, the two fastening metal fittings 4 are disposed transversely outside the disposition region of the five terminals 3 transversely disposed so as to be paired with each other with respect to the transversely direction.

Figure 14:
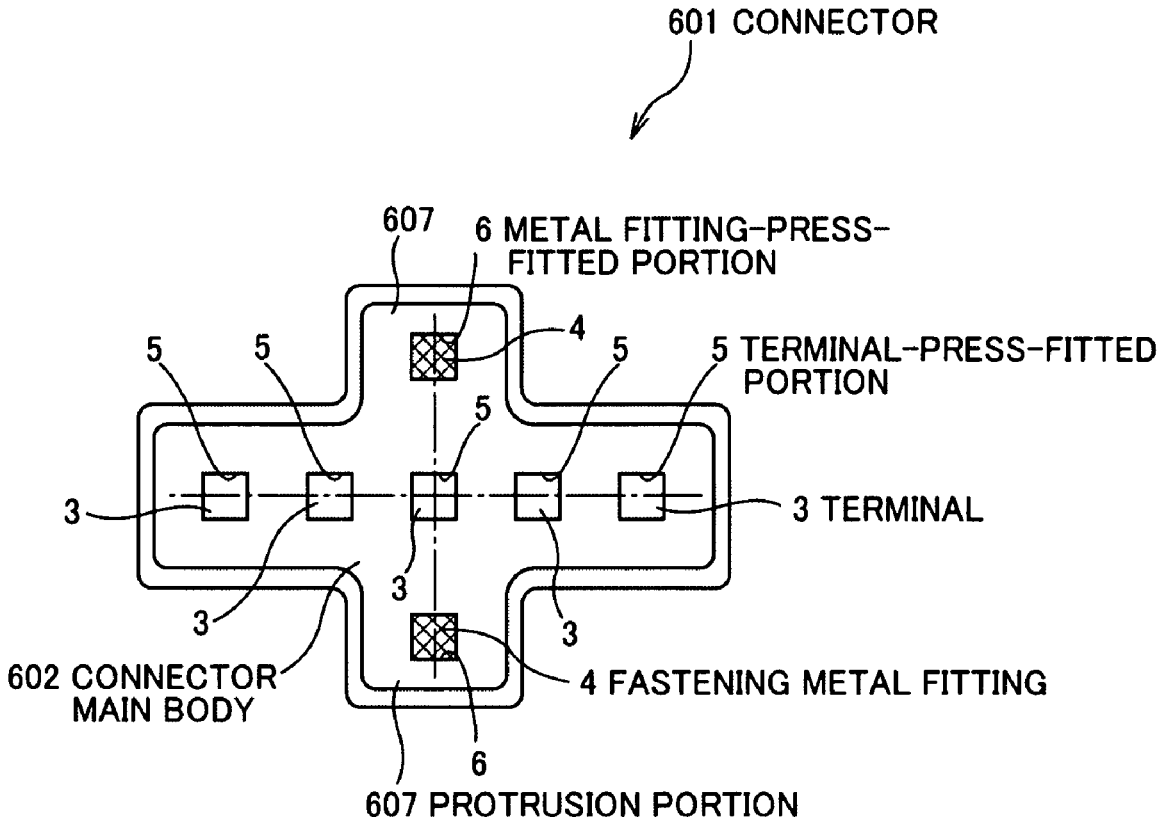
FIG. 14 is a top plan view of a connector according to a fifth change of the first and second embodiments of the invention.
Figure 15:
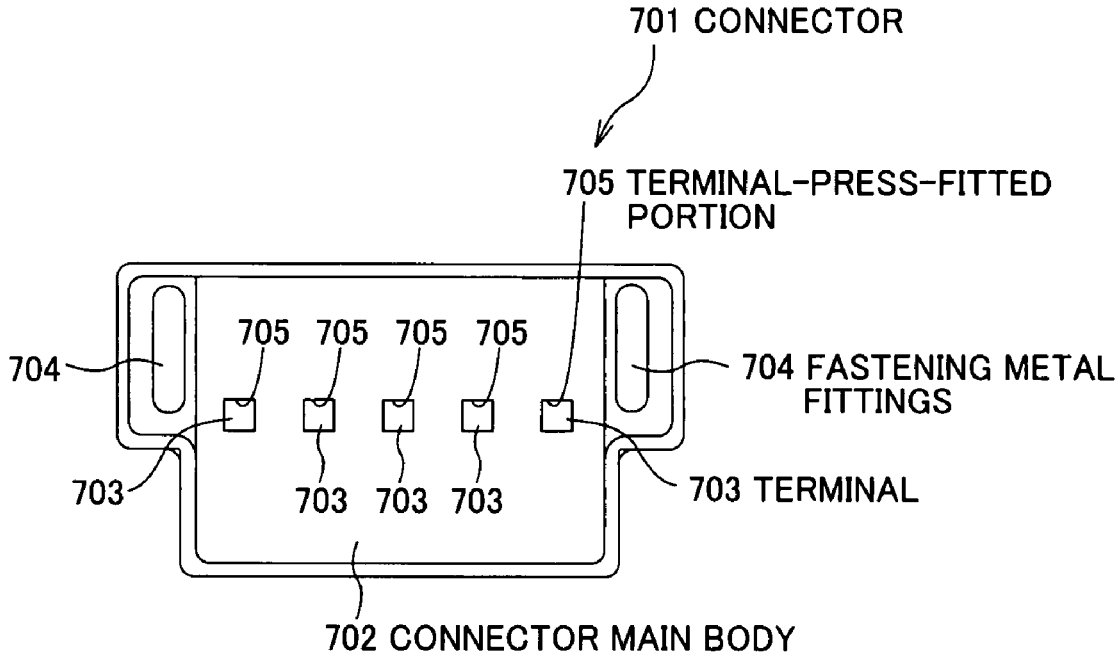
FIG. 15 is a top plan view of a conventional connector.
Figure 16:
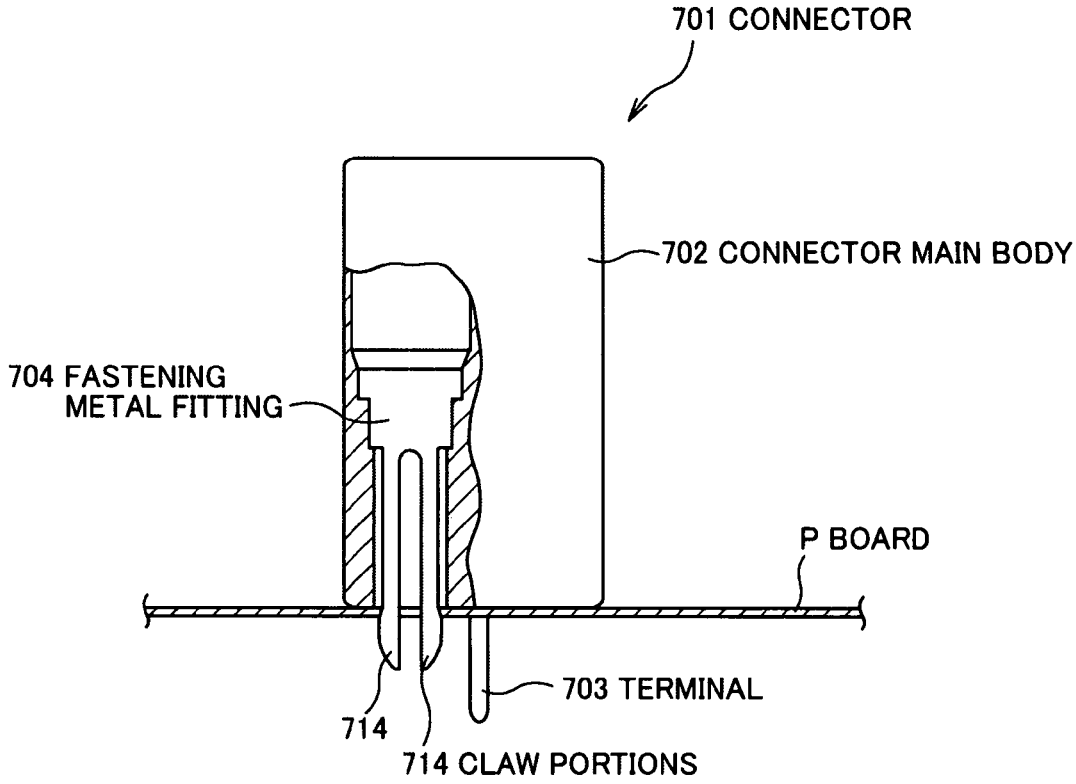
FIG. 16 is a side elevational view partly in cross section of the conventional connector shown in FIG. 15.

Furthermore, for example, as shown in FIG. 14, a connector 601 may also be available in which one protrusion portion 607 protruding forward is formed in a front portion of a connector main body 602, and the other protrusion portion 607 protruding backward is formed in a back portion of the connector main body 602. In the connector 601, one fastening metal fitting 4 is disposed in each of the two protrusion portions 607, and also the two fastening metal fittings 4 are disposed so as to be paired with each other on the front and back sides of the connector main body 602 with respect to the longitudinal direction.

In addition, although the first and second embodiments have shown the connectors 1 and 101 in each of which each of the terminal-press-fitted portions 5 and the metal fitting-press-fitted portion 6 has the extension portion 8 and the angular portion 9, alternatively, for example, each of the terminal-press-fitted portions 5 and the metal fitting-press-fitted portion 6 may be formed in the form of a tapered cavity. Thus, the shape of each of the terminal-press-fitted portions 5 and the metal fitting-press-fitted portion 6 can be arbitrarily formed.

In addition, although the first and second embodiments have shown the connectors 1 and 101 in each of which the five terminals 5 are transversely disposed in line, the number of terminals 3, and the disposition thereof are arbitrarily set. In addition, although the first and second embodiments have shown the connectors 1 and 101 in each of which each of the connector main bodies 2 and 102 is formed to be larger in the transverse direction than in the longitudinal direction when viewed from the upper part, for example, each of the connector main bodies 2 and 102 may be formed in the same size with respect to the longitudinal direction and the transverse direction, or may be formed to be larger in the longitudinal direction than in the transverse direction. Thus, the longitudinal size and the transverse size of each of the connector main bodies 2 and 102 can be arbitrarily set. Moreover, although the first and second embodiments have shown the connectors 1 and 101 in each of which the extension portion 8 of each of the terminal-press-fitted portions 5 is formed to be vertically longer than that of each of the metal fitting-press-fitted portions 6, the extension portion 8 of each of the terminal-press-fitted portions 5 may be formed to be vertically shorter than that of each of the metal fitting-press-fitted portions 6, or the extension portion 8 of each of the terminal-press-fitted portions 5 may be formed to be identical in vertical length to that of each of the metal fitting-press-fitted portions 6. Similarly to this, although the first and second embodiments have shown the connectors 1 and 101 in each of which the straight portion 15 of each of the terminals 3 is formed to be longer than that 12 of each of the fastening metal fittings 4, the straight portion 15 of each of the terminals 3 may be formed to be shorter than that 12 of each of the fastening metal fittings 4, or the straight portion 15 of each of the terminals 3 may be formed to be identical in length to that 12 of each of the fastening metal fittings 4. In addition thereto, it is to be understood that the concrete constructions or the like of the details of the constituent elements can be suitably changed.

What is claimed is:

1. A connector, comprising:

a plurality of terminals electrically connected to a fastening member;

a plurality of fastening metal fittings mechanically, fixedly fastened to said fastening member; and a connector main body, said terminals and said fastening metal fittings being fixedly fastened to said connector main body so as to have a predetermined positional relationship;

wherein each of said fastening metal fittings has a positioning position fixedly fastened to said connector main body, and a claw portion having a single protrusion, said claw portions being inserted through fastening hole portions of said fastening member, thereby preventing said connector from dropping out from the said fastening hole portions wherein each of said terminals has a positioning portion fixedly fastened to said connector main body, and said positioning portion of each of said fastening metal fittings has the same shape as that of the said positioning portion of each of said terminals.

2. A connector according to claim 1, wherein said positioning portion of each of said terminals is formed in a vertically central portion of a vertically long straight portion of each of said terminals, and is press-fitted into an angular portion of corresponding one of press-fitted portions of said connector main body.

3. A connector according to claim 1, wherein said connector main body has press-fitted portions to which said positioning portions of said fastening metal fittings, and said positioning portions of said terminals are fixedly fastened, respectively.

4. A connector according to claim 3, wherein a back side of said connector main body protrudes transversely and outward in transverse both ends of said connector main body with respect to a front side thereof to form two protrusion portions, and two metal fitting-press-fitted portions are disposed longitudinally side by side in each of the two protrusion portions.

5. A connector according to claim 3, wherein parts of said connector main body protrude transversely and outward in transverse both ends of said connector main body with respect to other parts thereof to form two protrusion portions, and one metal fitting-press-fitted portion is disposed in each of said two protrusion portions.

6. A connector according to claim 3, wherein said connector main body is formed approximately in box shape having no protrusion, and said fastening metal fittings are disposed in four corners of said connector main body, respectively.

7. A connector according to claim 3, wherein said connector main body has a protrusion portion protruding backward, and said fastening metal fittings are disposed transversely inside said protrusion portion so as to be paired with each other on both end sides of said connector main body with respect to a transverse direction.

8. A connector according to claim 3, wherein said connector main body has a protrusion portion protruding backward on a left-hand side of said connector main body and a protrusion portion protruding forward on a right-hand side of said connector main body, and said fastening metal fittings are disposed so as to be paired with each other on both end sides of said connector main body with respect to a transverse direction.

9. A connector according to claim 3, wherein said connector main body is formed in straight line shape, and said fastening metal fittings are disposed transversely outside said terminals disposed transversely so as to be paired with each other in a transverse direction.

10. A connector according to claim 3, wherein said connector main body has protrusion portions which protrude formed and backward, respectively, and which are formed in a front portion and a back portion of said connector main body, respectively, and corresponding one of said fastening metal fittings is disposed in each of said protrusion portions, and said fastening metal fittings are also disposed so as to be paired with each other on both end sides of said connector main body with respect to a longitudinal direction.

11. A connector according to claim 1, wherein said connector main body is formed from a resin.

12. A connector according to claim 3, wherein each of said press-fitted portions of said connector main body is a cavity formed inside said connector main body, and has an extension portion which vertically extends, and an angular portion which is formed in a predetermined portion of said extension portion so as to expand longitudinally.

13. A connector according to claim 3, wherein each of said press-fitted portions of said connector main body has an upper loose hole which is formed above corresponding one of said press-fitted portions so as to extend from an upper end of said connector main body to an upper end of the corresponding one of said extension portions, and a lower loose hole which is formed below the corresponding one of said press-fitted portions so as to extend from a lower end of said connector main body to a lower end of the corresponding one of said extension portions, said upper loose hole and said lower loose hole have respective cross sections each being larger than that of each of said press-fitted portions and communicate with the corresponding adjacent two of said press-fitted portions.

14. A connector according to claim 3, wherein each of said press-fitted portions is formed in a form of a tapered cavity.

15. A connector according to claim 3, wherein said press-fitted portions of said connector main body are formed in a form of terminal-press-fitted portions into which said positioning portions of said fastening metal fittings are press-fitted, respectively, and metal fitting-press-fitted portions into which said positioning portions of said terminals are press-fitted, respectively, so as to have the same shape.

16. A connector according to claim 1, wherein said claw portions of said plurality of fastening metal fittings fixedly fastened to said connector main body are engaged with said fastening hole portions of said fastening member, respectively.

17. A connector according to claim 1, wherein each of said claw portions of said plurality of fastening metal fittings is formed approximately in semicircular shape.

18. A connector according to claim 4, wherein the corresponding ones of said claw portions of said fastening metal fittings on the front side in each of said protrusion portions are disposed so as to protrude forward, and the corresponding ones of said claw portions of said fastening metal fittings on the back side in each of said protrusion portions are disposed so as to protrude backward.

19. A connector according to claim 1, wherein said terminals and said fastening metal fittings are assembled to said connector main body by press fitting in the same process.

* * * * *